US007444689B2

(12) United States Patent
Chiang

(10) Patent No.: US 7,444,689 B2
(45) Date of Patent: Nov. 4, 2008

(54) SWIMMING GOGGLES

(76) Inventor: Herman Chiang, 11F-2, No. 634-9, Ching-Ping Rd., Chung-Ho City, Taipei Hsien (TW)

( * ) Notice: Subject to any disclaimer, the term of this patent is extended or adjusted under 35 U.S.C. 154(b) by 233 days.

(21) Appl. No.: 11/434,770

(22) Filed: May 17, 2006

(65) Prior Publication Data

US 2007/0277297 A1 Dec. 6, 2007

(51) Int. Cl.
*A61F 9/02* (2006.01)

(52) U.S. Cl. ..... 2/428; 2/448

(58) Field of Classification Search ..... 2/426, 2/428, 440, 442, 445, 448; 351/43
See application file for complete search history.

(56) References Cited

U.S. PATENT DOCUMENTS 5,617,588 A * 4/1997 Canavan et al. ..... 2/428
7,181,778 B1 * 2/2007 Garraffa et al. ..... 2/428
7,210,175 B2 * 5/2007 Chiang ..... 2/450
2004/0143889 A1 * 7/2004 Chou ..... 2/445
2005/0015863 A1 * 1/2005 Chiang ..... 2/442

* cited by examiner

*Primary Examiner*—Katherine Moran
(74) *Attorney, Agent, or Firm*—Rosenberg, Klein & Lee

(57) ABSTRACT

Swimming goggles include a soft lens frame with an inner section and an outer section, a hard holding frame with an upper body and a lower body, biasing blocks for pressing the upper body and the lower body, and a strap element with a head strap. The inner section defines receiving slots for receiving eyeglasses therein. A mask-like protective pad is integrated with the inner section. The outer section forms at least a stuffing portion. The holding frame clamps the outer section of the lens frame. At least a hollow-cutting portion is formed on the holding frame and corresponds to the stuffing portion respectively. The swimming goggles have reduced weight and sound flexibility because of the hollow-cutting portions, and fit to users' faces and noses suitably.

15 Claims, 6 Drawing Sheets

SWIMMING GOGGLES

BACKGROUND OF THE INVENTION

1. Field of the Invention

The present invention relates to swimming goggles, and particularly to swimming goggles which have a protective pad and is light that could be able to match for various users with different width faces and effectively prevent from water leakage.

2. Related Art

Conventional swimming goggles with a mask-like protective pad generally include a protective pad enveloping lens therein, a holding frame holding the protective pad and having gaps at both ends thereof, connecting buckles for pressing the holding frame, and adjusting buckles for adjusting length of a head strap. For example, such conventional swimming goggles are shown in U.S. Pat. Nos. 4,279,040, 6,459,420, 6,276,794 etc. It's so troublesome because the conventional swimming goggles have to be taken down each time a head strap needs to be adjusted. Some designers integrate the connecting buckles with the adjusting buckles together for simplifying adjustment of the head strap, as disclosed in U.S. patent application Ser. Nos. 11/319,176, 29/223,178.

Nevertheless, the swimming goggles mentioned above all weigh too much due to so many inevitable accessories, for example the mask-like protective pad and connecting buckles. Furthermore, width of users' faces may be different from person to person. The protective pad could not fit close to users' foreheads because of hard lens frames, correspondingly taking risk of water seepage yet.

SUMMARY OF THE INVENTION

Accordingly, an object of the present invention is to provide light swimming goggles which match for various users with different width faces and effectively prevent from water leakage.

The swimming goggles comprise a soft lens frame, a hard holding frame, biasing blocks and a strap element. The soft lens frame includes an inner section and an outer section. The inner section defines receiving slots for receiving eyeglasses therein. A mask-like protective pad is integrated with the inner section. The outer section forms at least a stuffing portion. The holding frame clamps the outer section of the lens frame, and includes an upper body and a lower body. At least a gap is defined between the upper body and the lower body. At least a hollow-cutting portion is formed on the holding frame and corresponds to the stuffing portion respectively. The biasing blocks press the upper body and the lower body of the holding frame. The strap element is assembled on the biasing blocks and includes a head strap.

Locking grooves are distributed around the stuffing portions for facilitating the stuffing portions to be embedded into the hollow-cutting portions.

DESCRIPTION OF THE PREFERRED EMBODIMENTS

Figure 1:
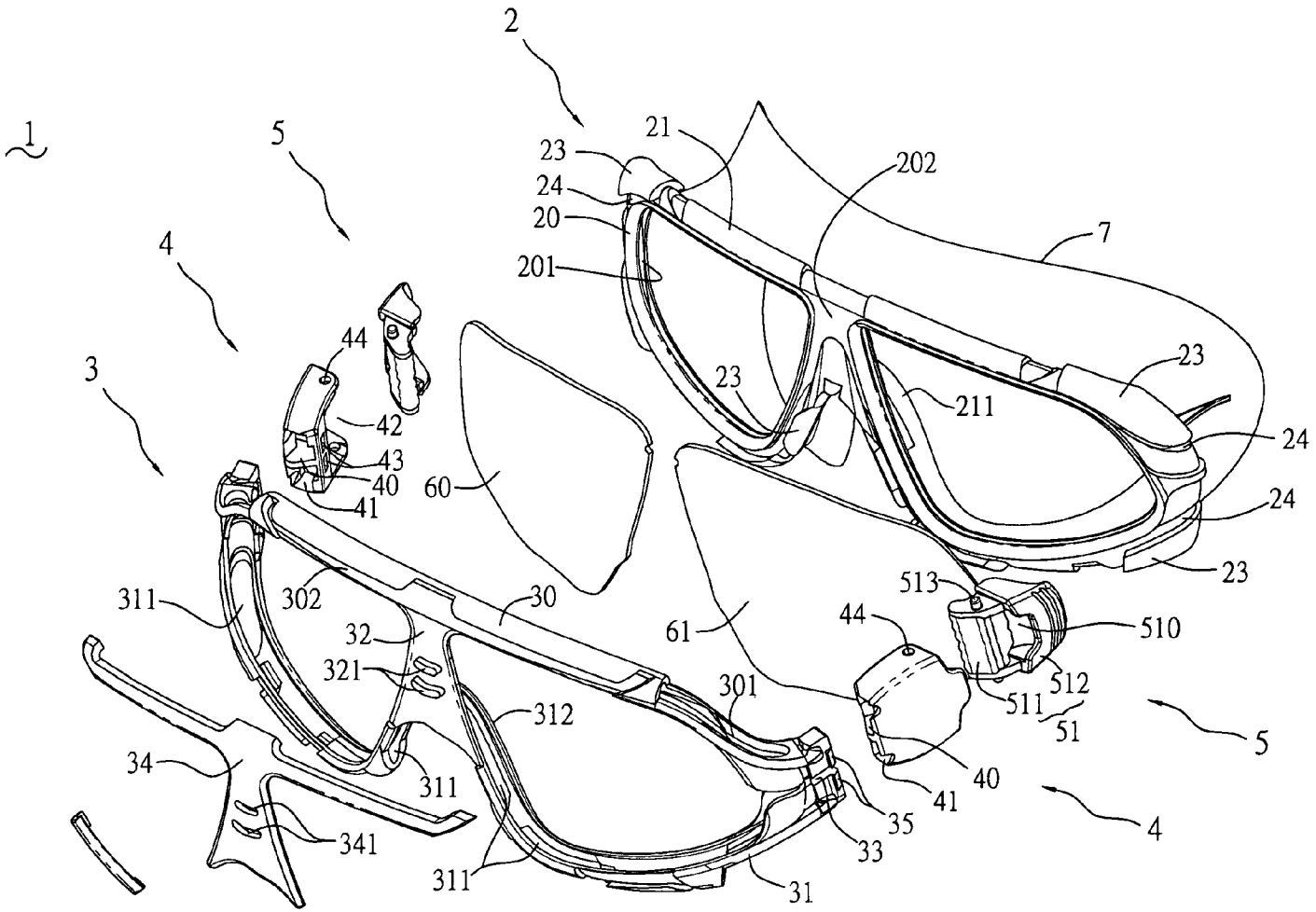
FIG. 1 is an exploded view of swimming goggles of the present invention.

With reference to FIG. 1, swimming goggles 1 in accordance with the present invention comprise a soft lens frame 2, a hard holding frame 3, biasing blocks 4 and a strap element 5. The lens frame 2 is unitarily formed of silicone, and has an inner section 20 and an outer section 21. The inner section 20 defines a pair of receiving slots 201 for receiving eyeglasses 60, 61. A rib 202 is formed between the receiving slots 201. A mask-like protective pad 7 is integrally formed on a side of the inner section 20 for touching to a user's face comfortably. A plurality of stuffing portion 23 is formed on the outer section 21. Locking grooves 24 are defined around the stuffing portions 23, respectively. An arcuate nosepiece 211 is formed on a middle of a lower portion of the outer section 21. A stuffing portion 23 is disposed above the nosepiece 211 and close to a user's nose in use.

The holding frame 3 is made of PP, and includes an upper body 30 and a lower body 31 for holding the outer section 21 of the lens frame 2. The upper body 30 and the lower body 31 respectively form hollow-cutting portion 301, 311 thereon for corresponding to the stuffing portions 23, thereby reducing whole weight of the swimming goggles 1 and enhancing flexibility and fitness to a user's face. The hollow-cutting portions 301, 311 comprise hollow-cutting portions formed in the vicinity of the gaps 33 for yielding flexibility thereby fitting to a user's face. In assembly, the stuffing portions 23 are individually embedded into the hollow-cutting portions 301, 311, and edges of the hollow-cutting portions 301, 311 extend into the locking grooves 24, facilitating the stuffing portions 23 to be embedded into the hollow-cutting portions 301, 311. A middle post 32 is integrally formed with middle portions of the upper body 30 and the lower body 31. The lower body 31 forms an arcuate support portion 312 in middle thereof and with the same shape as the nosepiece 211 for fitting to a user's nose, and also have the hollow-cutting portion 311 to corresponds the supplemental stuffing portion 23 of the nosepiece 211. Gaps 33 are defined between ends of the upper body 30 and the lower body 31. A generally T-shaped enhanced portion 34 is made of TPR, and is assembled on the middle post 32 and the upper body 30. The enhanced portion 34 defines assembling holes 341 therein, and the middle post 32 forms retaining projections 321 for engaging with the assembling holes 341. The upper body 30 forms a mounting groove 302 therein for receiving the enhanced portion 34. Thus, the upper body 30 possesses enhanced strength and fits for a user's nose exactly. First latching portions are formed at ends of the upper body 30 and the lower body 31 and near the gaps 33. In one embodiment, the first latching portions include anchors 35 on edges of the upper body 30 and the lower body 31 which are opposing to each other.

Figure 5:
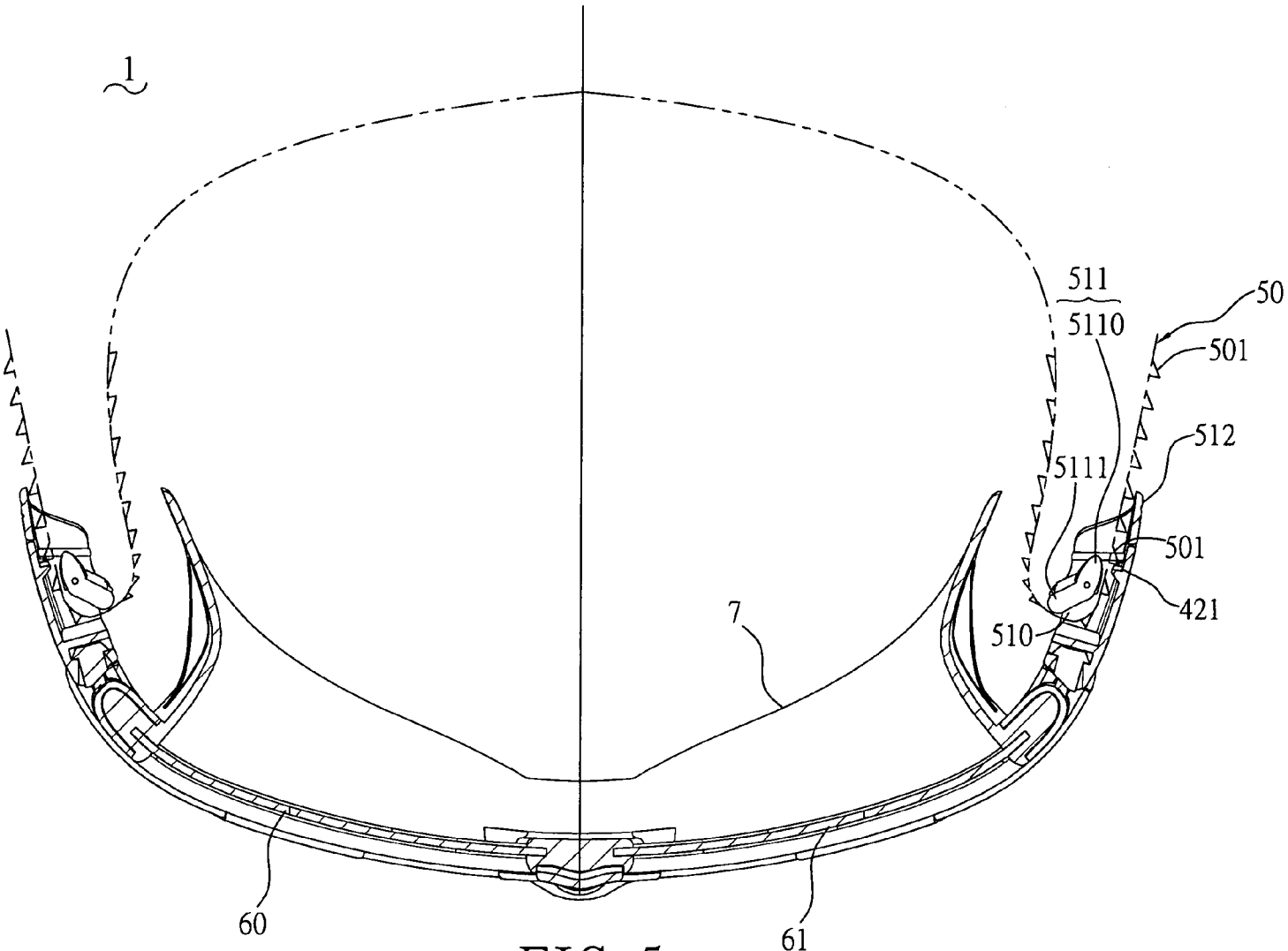
FIG. 5 is a cross-sectional view taken along the line 5-5 in FIG. 4.

The biasing blocks 4 are assembled on the upper body 30 and the lower body 31 and press the gaps 33 inwardly. Each biasing block 4 has pressing portions 40, 41 for pressing the gaps 33, and defines an assembling slot 42 adjacent to the pressing portions 40, 41. Second latching portions are formed respectively in the pressing portions 40, 41 for corresponding to the first latching portions. In one embodiment, the second latching portions include latching grooves 43 for latching to the anchors 35. A stopping block 421 is formed in the assembling slot 42 for abutting against stopping grooves 501 in a head strap 50 of the strap element 5, as shown in FIG. 5.

Referring to FIG. 1, the biasing blocks 4 further define axis holes 44 therein for engaging with adjusting buckles 51 of the strap element 5.

Figure 4:
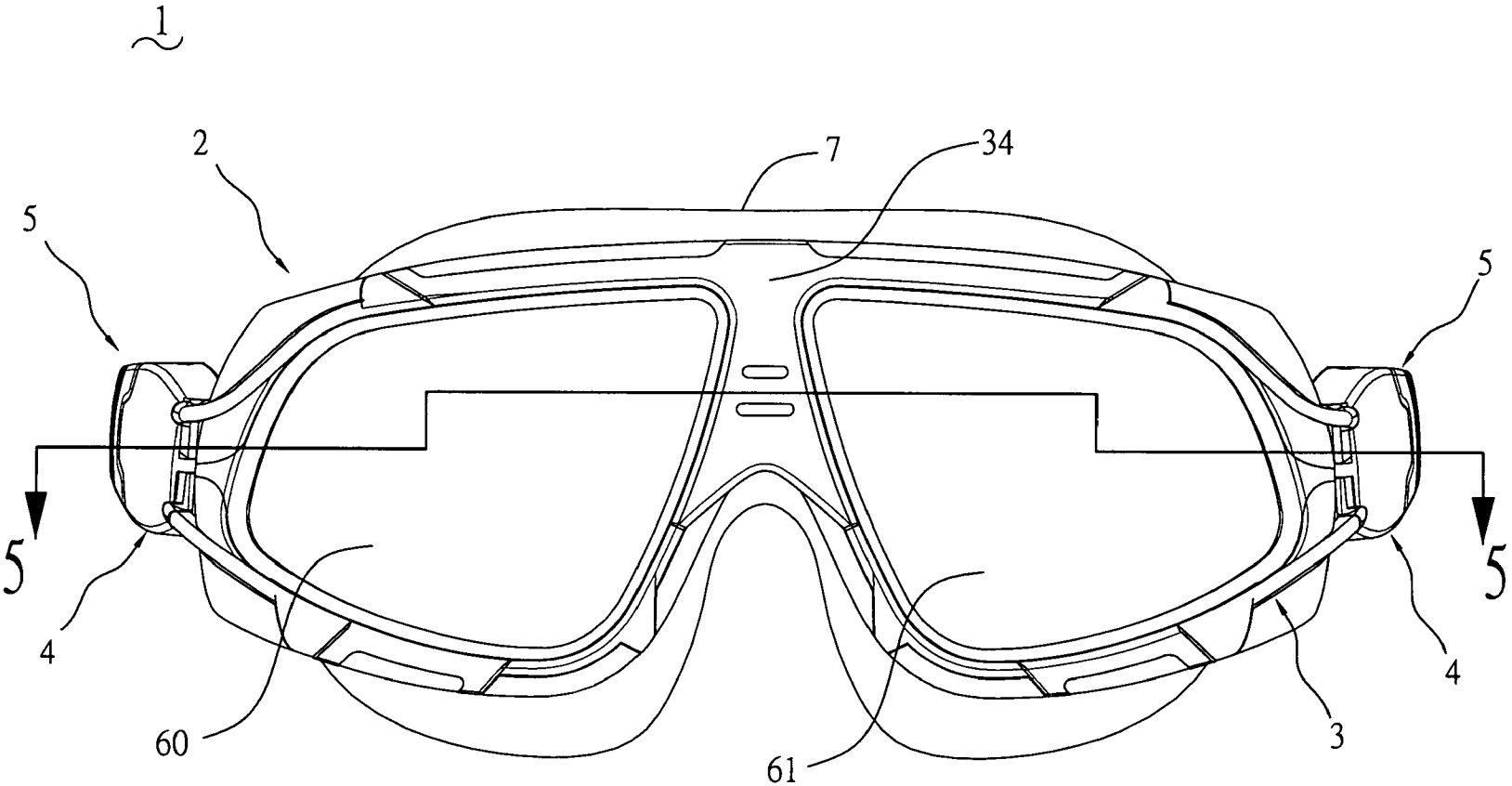
FIG. 4 is a front view of the swimming goggles of FIG. 3.

The strap element 5 comprises adjusting buckles 51 and a head strap 50 extending through the adjusting buckles 51. Each adjusting buckle 51 includes an L-shaped moving bar 511 and a pressing button 512 offsetting from the moving bar 511. A space 510 is defined between the moving bar 511 and the pressing button 512 for accommodating the head strap 50. A pivoting shaft 513 is formed on a corner of moving bar 511 for pivoting to the axis holes 44, whereby first and second ends 5110, 5111 of the moving bar 511 are allowed to act as leverage. The pressing button 512 is located on a side of the moving bar 511. Where the pressing button 512 is pressed, the moving bar 511 is allowed simply to move reversely towards the other side. Referring to FIG. 4, in assembly, the head strap 50 is extended through the space 510. The stopping blocks 421 abut against the stopping grooves 501 of the head strap 50. In normal state, the head strap 50 is permitted to move in a single direction tending to tighten. In event that the pressing buttons 512 are pressed, the first ends 5110 of the moving bars 511 are pressed downward. Consequently, the second ends 5111 of the moving bars 511 push the head strap 50, resulting in the stopping blocks 421 disengage from the stopping grooves 501. As a result, the head strap 50 is also allowed to move toward loosening and tightening.

Figure 2:
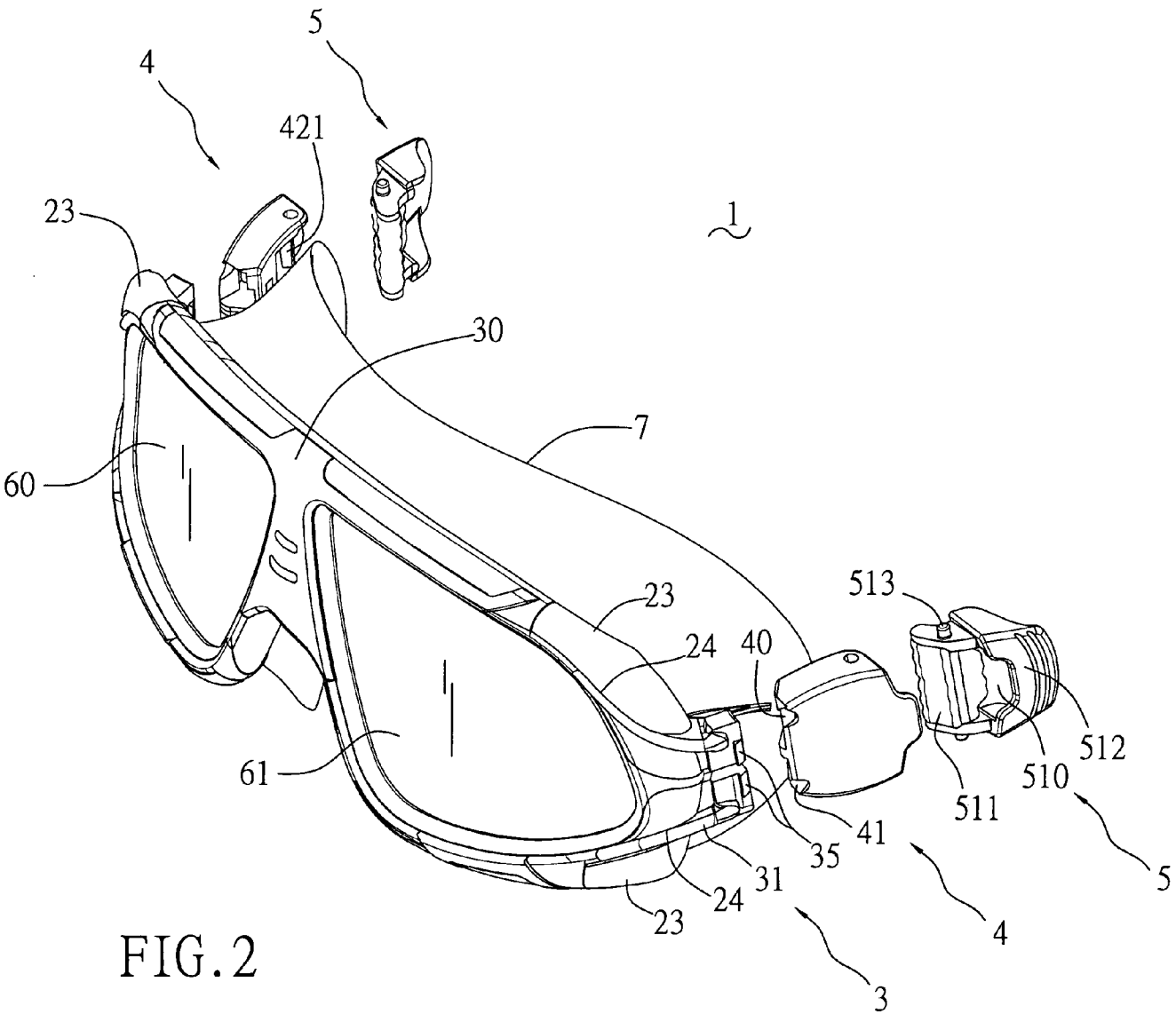
FIG. 2 is a partially assembled view of the swimming goggles of FIG. 1.
Figure 3:
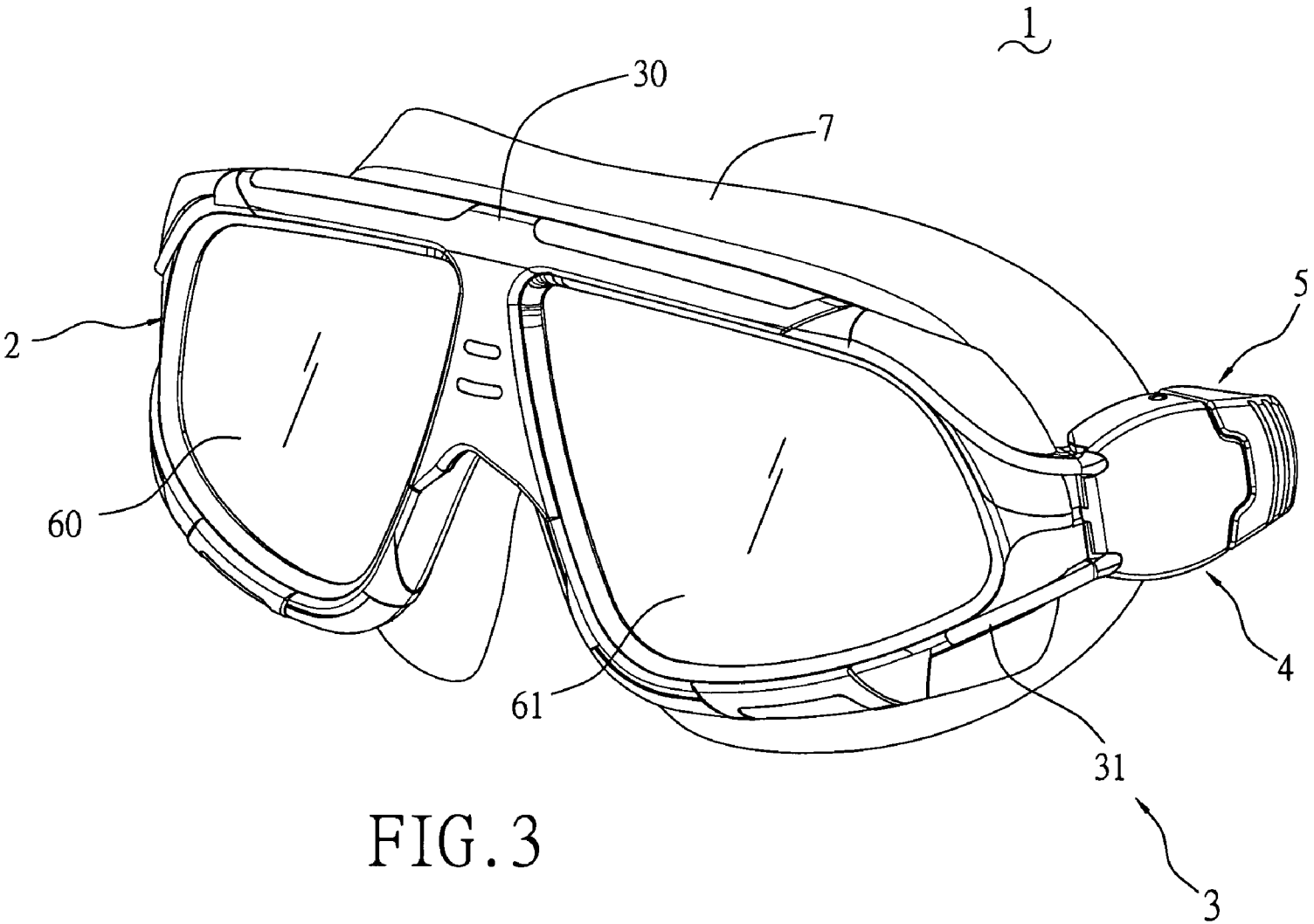
FIG. 3 is an assembled view of the swimming goggles of FIG. 1.

Referring to FIGS. 2 and 3, the swimming goggles 1 are assembled in sequence. The eyeglasses 60, 61 are assembled into the receiving slots 201 of the soft lens frame 2. The upper body 30 and the lower body 31 clamp the outer section 21 of the lens frame 2. The stuffing portions 23 are respectively filled into the hollow-cutting portions 301, 311. The pressing portions 40, 41 press the gaps 33 narrower, urging the lens frame 2 to secure the eyeglasses 60, 61. The anchors 35 of the upper body 30 and the lower body 31 latch with the latching grooves 43, further securing the lens frame 2 with the eyeglasses 60, 61 therein.

Figure 6:
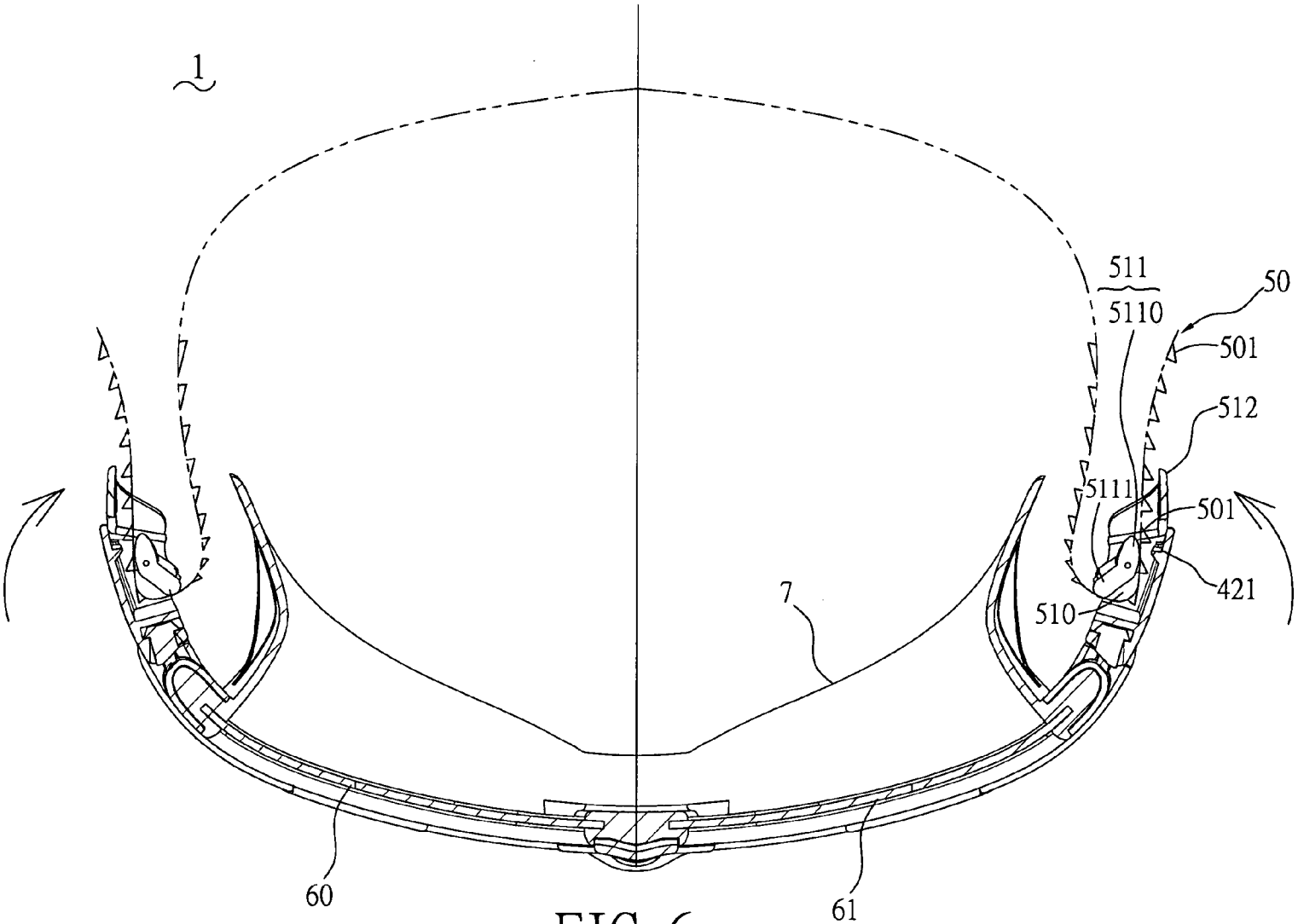
FIG. 6 schematically shows a head strap of the swimming goggles being adjusted.

Referring to FIG. 5, in normal state, the stopping blocks 421 engage with the stopping grooves 501 of the head strap 50. Meanwhile the head strap 50 is only movable toward tightening. Referring to FIG. 6, the first ends 5110 of the moving bars 511 are pressed downward when the pressing buttons 512 are pressed. The second ends 5111 of the moving bars 511 push the head strap 50, driving the stopping blocks 421 to disengage from the stopping grooves 501. At this time the head strap 50 is allowed to move in both directions toward loosening and tightening.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

a soft lens frame including an inner section and an outer section, the inner section defining receiving slots for receiving eyeglasses therein, a mask-like protective pad being integrated with the inner section, the outer section forming at least a stuffing portion;

a hard holding frame clamping the outer section of the lens frame, and including an upper body and a lower body, at least a gap being defined between the upper body and the lower body, at least a hollow-cutting portion being formed thereon and corresponding to the stuffing portion respectively;

biasing blocks pressing the upper body and the lower body of the holding frame; and a strap element at least including a head strap;

wherein the lens frame is unitarily formed of silicone, and forms a rib between the receiving slots;

wherein the holding frame is made of polypropylene (PP), an arcuate support portion is formed intermediately on the lower body for fitting to a user's nose, and a middle post is integrally formed with middle portions of the upper body and the lower body;

wherein a generally T-shaped enhanced portion is made of thermoplastic rubber (TPR), and is assembled on the middle post and the upper body, and wherein the enhanced portion defines assembling holes therein, and the middle post forms retaining projections for engaging with the assembling holes.

2. The swimming goggles as claimed in claim 1, wherein locking grooves are distributed around the stuffing portions for facilitating the stuffing portions to be embedded into the hollow-cutting portions in assembly.

3. The swimming goggles as claimed in claim 1, wherein the arcuate support portion also have the hollow-cutting portion.

4. The swimming goggles as claimed in claim 3, wherein an arcuate nosepiece is formed on a middle of a lower portion of the outer section, the arcuate nosepiece corresponding in shape to the arcuate support portion, the outer section having the stuffing portion thereon embedded into the hollow-cutting portions in assembly.

5. Swimming goggles comprising:

a soft lens frame including an inner section and an outer section, the inner section defining receiving slots for receiving eyeglasses therein, a mask-like protective pad being integrated with the inner section, the outer section forming at least a stuffing portion;

a hard holding frame clamping the outer section of the lens frame, and including an upper body and a lower body, at least a gap being defined between ends of the upper body and the lower body, at least a hollow-cutting portion being formed thereon and corresponding to the stuffing portion respectively, first latching portions being formed at ends of the upper body and the lower body and near the gaps;

biasing blocks connecting the upper body and the lower body of the holding frame for pressing the gaps, and including pressing portions, second latching portions being formed in the pressing portions for locking with the first latching portions; and a strap element assembled on the biasing blocks and at least including a head strap;

wherein the first latching portions include anchors on edges of the upper body and the lower body which are opposing to each other, the second latching portions include latching grooves for latching to the anchors.

6. The swimming goggles as claimed in claim 5, wherein the hollow-cutting portions comprise hollow-cutting portions fanned in the vicinity of the gaps for yielding flexibility thereby fitting to a user's face.

7. The swimming goggles as claimed in claim 5, wherein locking grooves are distributed around the stuffing portions for facilitating the stuffing portions to be embedded into the hollow-cutting portions in assembly.

8. The swimming goggles as claimed in claim 5, wherein the lens frame is unitarily Conned of silicone, and forms a rib between the receiving slots.

9. The swimming goggles as claimed in claim 8, wherein the holding frame is made of polypropylene (PP), an arcuate support portion is formed intermediately on the lower body for fitting to a user's nose, and a middle post is integrally formed with middle portions of the upper body and the lower body.

10. The swimming goggles as claimed in claim 5, wherein each biasing block defines an assembling slot adjacent to the pressing portions, a stopping block being formed in the assembling slot.

11. The swimming goggles as claimed in claim 10, wherein stopping grooves are defined in the head strap for corresponding to the stopping blocks.

12. Swimming goggles comprising:

a soft lens frame including an inner section and an outer section, the inner section defining receiving slots for receiving eyeglasses therein, a mask-like protective pad being integrated with the inner section, the outer section forming at least a stuffing portion;

a hard holding frame clamping the outer section of the lens frame, and including an upper body and a lower body, at least a gay being defined between ends of the upper body and the lower body, at least a hollow-cutting portion being formed thereon and corresponding to the stuffing portion respectively, first latching portions being formed at ends of the upper body and the lower body and neat the gaps;

biasing blocks connecting the upper body and the lower body of the holding frame for pressing the gaps, and including pressing portions, second latching portions being formed in the pressing portions for locking with the first latching portions; and a strap element assembled on the biasing blocks and at least including a head strap;

wherein the holding frame is made of polypropylene (PP), an arcuate support portion is formed intermediately on the lower body for fitting to a user's nose, and a middle post is integrally formed with middle portions of the upper body and the lower body;

wherein a generally T-shaped enhanced portion is made of thermoplastic rubber (TPR), and is assembled on the middle post and the upper body, and wherein the enhanced portion defines assembling holes therein, and the middle post forms retaining projections for engaging with the assembling holes.

13. The swimming goggles as claimed in claim 12, wherein the arcuate support portion also have the hollow-cutting portion.

14. The swimming goggles as claimed in claim 13, wherein an arcuate nosepiece is formed on a middle of a lower portion of the outer section, the arcuate nosepiece corresponding in shape to the arcuate support portion, the outer section having the stuffing portion thereon embedded into the hollow-cutting portions in assembly.

15. Swimming goggles comprising:

a soft lens frame including an inner section and an outer section, the inner section defining receiving slots for receiving eyeglasses therein, a mask-like protective pad being integrated with the inner section, the outer section forming at least a stuffing portion;

a hard holding frame clamping the outer section of the lens frame, and including an upper body and a lower body, at least a gap being defined between ends of the upper body and the lower body, at least a hollow-cutting portion being formed thereon and corresponding to the stuffing portion respectively, first latching portions being formed at ends of the upper body and the lower body and near the gaps;

biasing blocks connecting the upper body and the lower body of the holding frame for pressing the gaps, and including pressing portions, second latching portions being formed in the pressing portions for locking with the first latching portions; and a strap element assembled on the biasing blocks and at least including a head strap;

wherein each biasing block defines an assembling slot adjacent to the pressing portions, a stopping block being formed in the assembling slot;

wherein stopping grooves are defined in the head stray for corresponding to the stopping blocks;

wherein the swap element further comprises adjusting buckles assembled to the assembling slots of the biasing blocks, each adjusting buckle including moving bar and a pressing button offsetting from the moving bar, a space being defined between the moving bar and the pressing button for accommodating the head strap, a pivoting shaft being formed on a corner of moving bar for pivoting to the biasing blocks, and wherein when the pressing buttons are pressed, the moving bars move reversely, driving the stopping blocks to disengage from the stopping grooves.

* * * * *